US008197038B2

(12) United States Patent
Jones et al.

(10) Patent No.: US 8,197,038 B2
(45) Date of Patent: Jun. 12, 2012

(54) PRINTHEAD JETSTACK ALIGNMENT AND ASSEMBLY VERIFICATION FEATURES

(75) Inventors: Garry Adam Jones, Sherwood, OR (US); David Paul Platt, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 286 days.

(21) Appl. No.: 12/709,353

(22) Filed: Feb. 19, 2010

(65) Prior Publication Data

US 2011/0205302 A1 Aug. 25, 2011

(51) Int. Cl.
*B41J 2/045* (2006.01)

(52) U.S. Cl. ..... 347/71; 347/20; 347/47

(58) Field of Classification Search ..... 347/20, 347/47, 68–71; 29/890.1, 25.35
See application file for complete search history.

(56) References Cited

U.S. PATENT DOCUMENTS 5,825,382 A * 10/1998 Thiel ..... 347/40
6,672,715 B2 * 1/2004 Isono et al. ..... 347/71

* cited by examiner

*Primary Examiner* — Lamson Nguyen
(74) *Attorney, Agent, or Firm* — Marger Johnson & McCollom PC

(57) ABSTRACT

An apparatus has a first plate having a first array of holes, with a first plate alignment hole having a smaller size than the other holes in the array, a second plate having a second array of holes to be alignable to the first array of holes, a second plate alignment hole having a smaller size than the other holes in the array, and the first plate alignment hole and the second plate alignment hole having different positions. A method of aligning plates provides a first plate having a top and bottom and first array of holes including a first plate alignment hole having a size smaller than the other holes in the first array, places a second plate having a second array of holes on the top of the first plate such that the first array of holes and the second array of holes align, directs light at the bottom of the first plate, locates a profile of the first plate alignment hole in the second array of holes to verify alignment.

17 Claims, 10 Drawing Sheets

PRINTHEAD JETSTACK ALIGNMENT AND ASSEMBLY VERIFICATION FEATURES

BACKGROUND

Ink jet printers generally have a 'jet stack,' a stack of thin, brazed steel plates that have manifolds to route the ink from ink reservoirs to an array of jets from which ink is dispensed. The jet stack represents a substantial portion of the overall printer cost. Reduction of costs has resulted in reducing the size of the jet stack. Reducing the size lowers the amount of material needed, processing and shipping costs. This smaller size results in less room to fit the geometries for venting, printing, aligning and sequencing features. The assembly process needs the aligning and sequencing features to ensure that the plates are in the proper order and aligned correctly. Misaligned or out of order plates result in malfunctioning and/or lower efficiency print heads.

Currently, a sequencing feature referred to as 'stair steps' assists in ensuring the plates are stacked in the proper order. An edge of each plate has a tab of differing widths so that the stacked plates form a 'stair step' similar to stacked file folders or an index on the edge of the pages of a book. In addition, an alignment feature that ensures correct alignment in addition to the correct sequence also typically exists on the jet stack. U.S. Patent Application Publication US20080259121 shows an example of such an alignment feature.

These sequencing and alignment features take up quite a bit of real estate on the plates. This then contributes to larger jet stack plates, resulting in higher costs and larger print heads for a given print density.

DETAILED DESCRIPTION OF THE EMBODIMENTS

Figure 1:
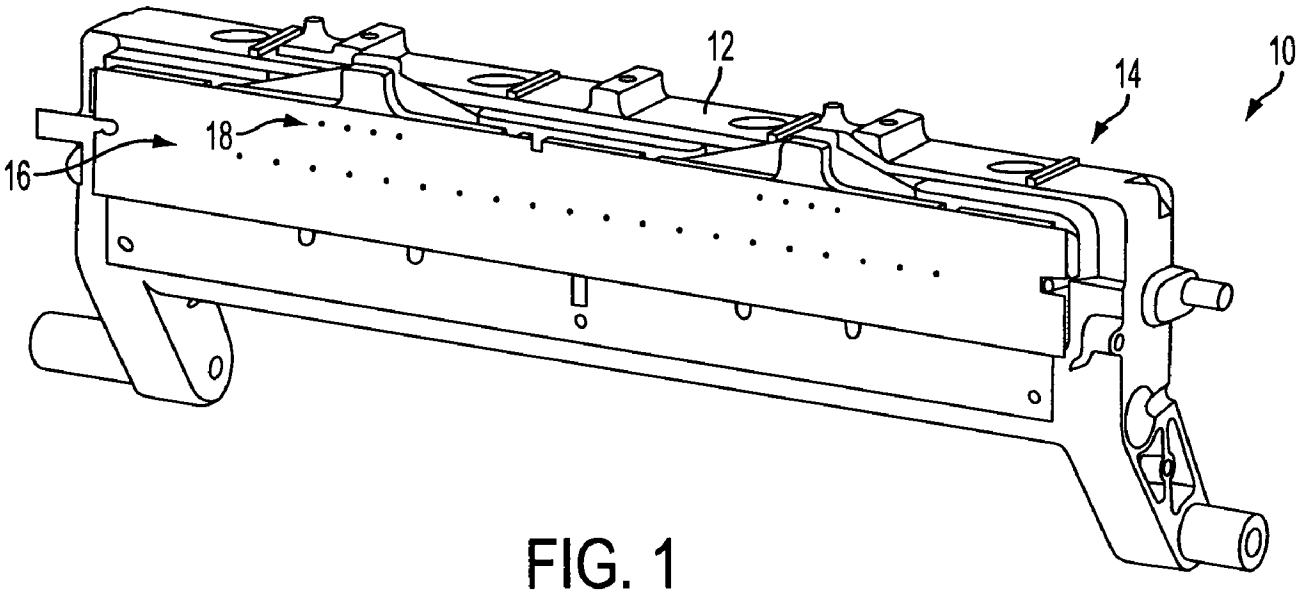
FIG. 1 shows an example of a jet stack.

FIG. 1 shows an example of a printhead jet stack. It must be noted that the particular print head and jet stack shown here are merely for discussion purposes and for ease of understanding of the invention. No limitation of any particular printhead or jet stack is intended, nor should any be implied. Further, one should note that the stacking and alignment feature shown here relates to jet stacks, but could be applicable to any apparatus that requires precise alignment of a series of plates or other planar bodies in a particular sequence.

In FIG. 1, the printhead 10 receives ink through umbilicals not shown on the back side of the printhead, with the ink coming into the printhead from the direction shown in arrow 14. The printhead shown here has a body 12 to which a jet stack 16 attaches. The jet stack attaches to the printhead body on the opposite side of the where the ink enters the printhead, generally. The ink routes through the printhead body and the various chambers and manifolds in the jet stack portion of the printhead. The ink exits the print head through an array of nozzles, or jets, such as 18 at the outside surface of the jet stack 16. Misalignment of the various plates in the jet stack 16 will cause the jets such as 18 to fail or operate much more inefficiently than desired. This may result in printer failure over time, or at the very least, objectionable artifacts in the resulting printed image.

Figure 2:
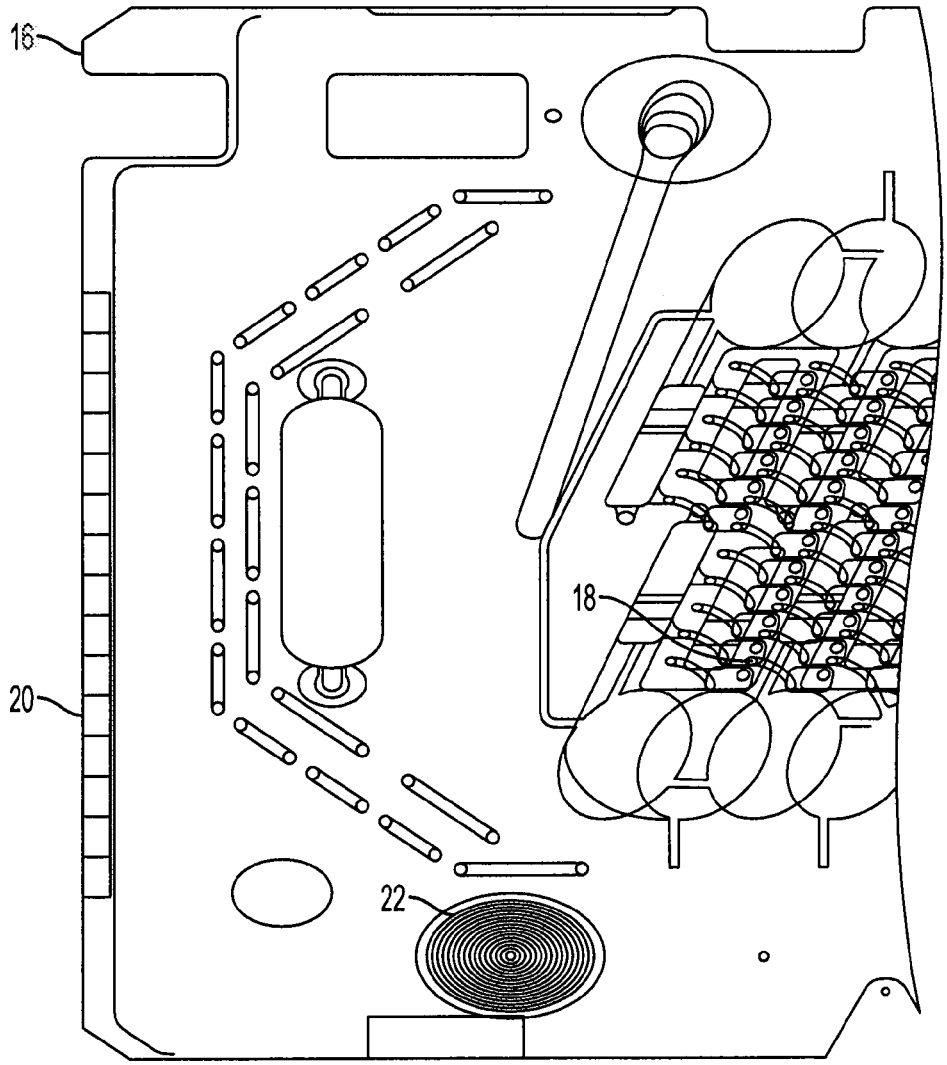
FIG. 2 shows an example of a surface of a jet stack having separated sequencing and alignment features.

FIG. 2 shows an example of a top surface of a jet stack 16. The array of nozzles such as 18 generally resides towards the center of the nozzle plate, which resides in the 'top' position of the jet stack. One should note that the discussion uses the term 'top' only to indicate that the nozzle plate resides in an outer position of the jet stack with one of its faces not interfacing with any other plates with the stack.

FIG. 2 shows examples of a sequencing feature and an alignment feature. The sequencing feature 20 resides to the left side of the figure, appearing as a series of tabs from the bottom of the drawing to the top of the drawing. These stair-stepped tabs allow a quick visual reference to ensure that the plates are sequenced correctly. If a plate is out of order, one of the tabs would break up the sequence of stair steps, either causing too large of a drop between tabs or having a step in the opposite direction from those in the sequence.

The alignment feature 22 in this example appears a series of concentric circles. Each of the smaller circles resides on plates behind the front plate, forming a conical shape going into the stack. A vision system generally views the series of circles and checks for circles that are not concentric, such as being shifted up, down or to either side.

Figure 3:
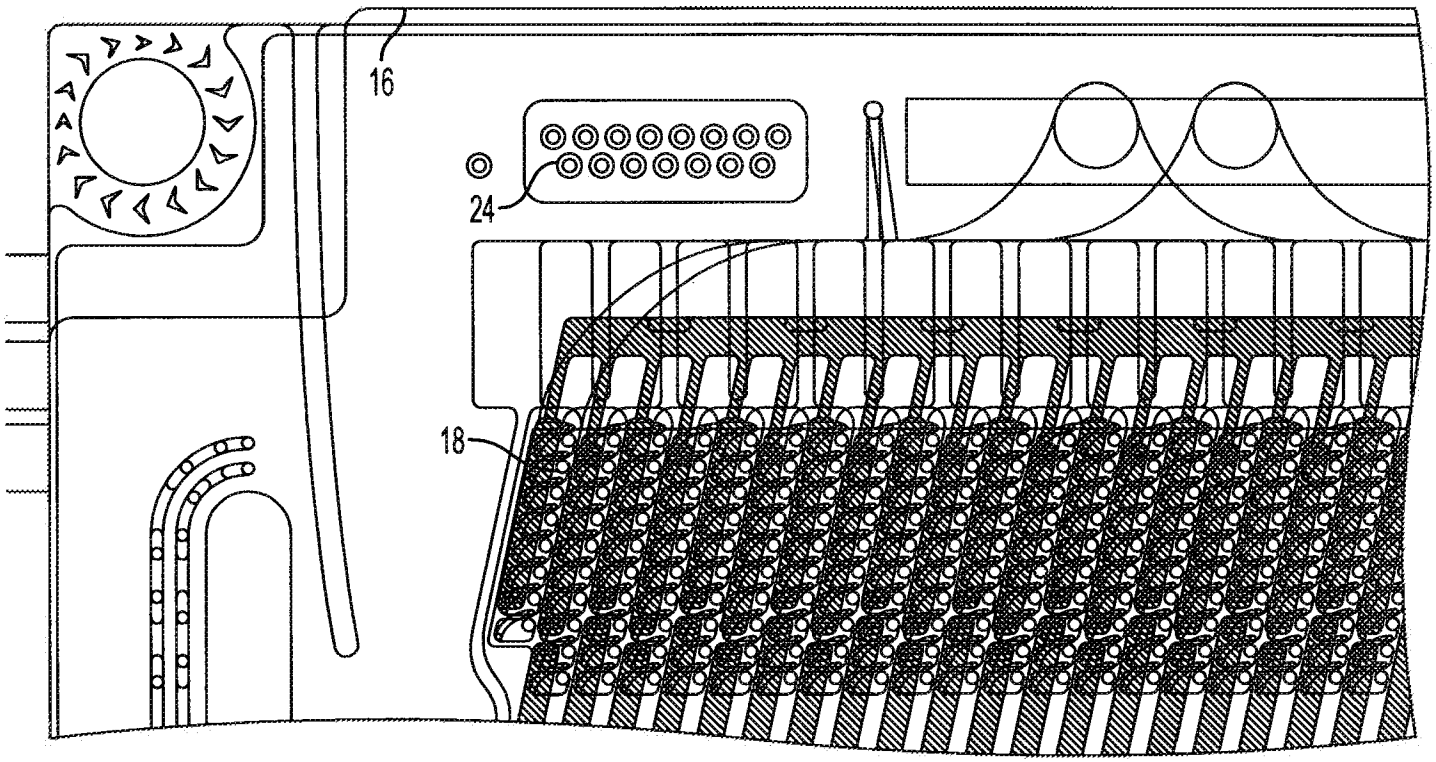
FIG. 3 shows an example of an alternative alignment feature.

FIG. 3 shows an alternative embodiment of an alignment feature 24 viewed from the front or top plate of the jet stack 16. In this example, the alignment feature resides above the array of jets such as 18, but could reside in the same location as the other alignment feature of FIG. 3. Using the conical type alignment feature may result in issues with reflection off the smaller circle edges since the plates generally consist of metal. In the alignment feature shown in FIG. 3, each plate has the array of holes shown at 24, with one hole in the array smaller than the rest. The smaller hole on each plate resides in a different position than the smaller holes for the other plates. This results in each larger hole in the array outlining a smaller hole as shown. U.S. Patent Publication No. 2008/0259121 shows an example of this approach to alignment features.

Figure 4:
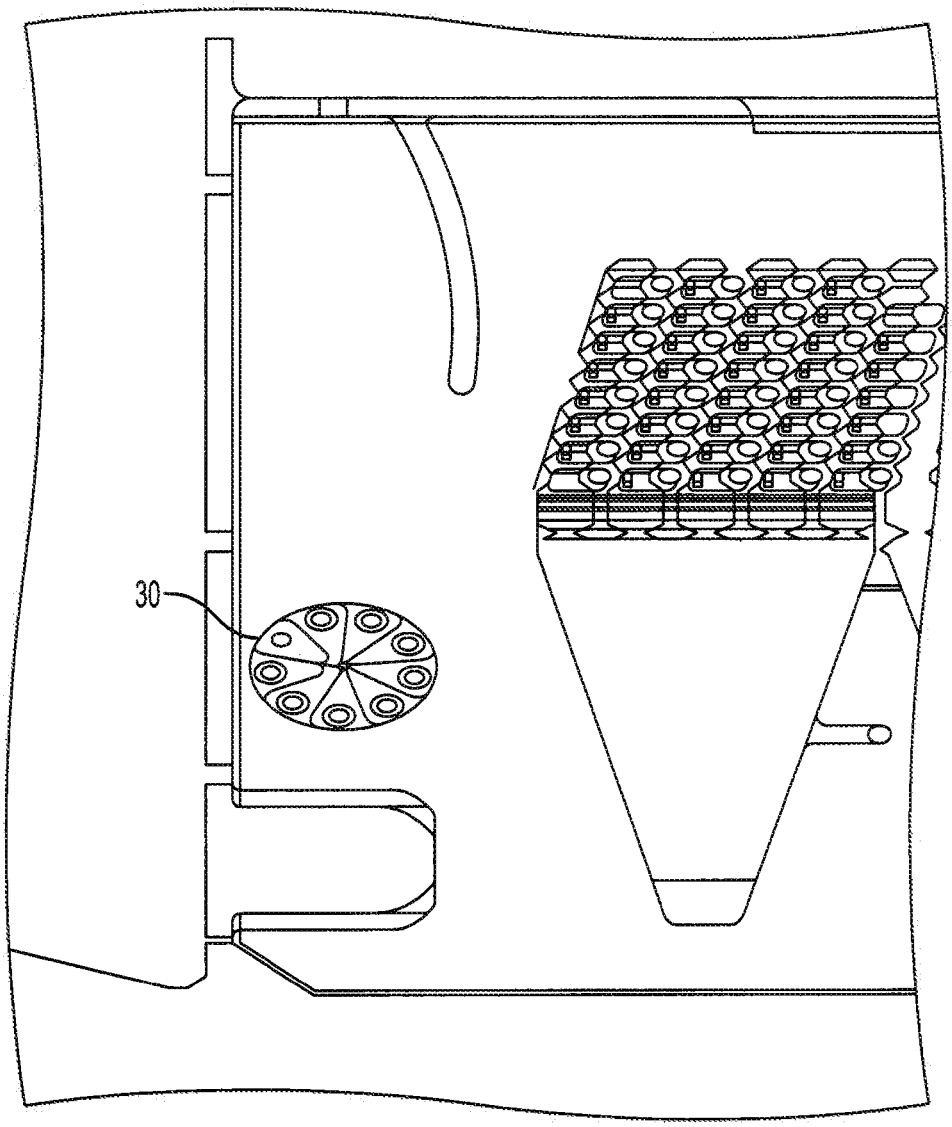
FIG. 4 shows an embodiment of a jet stack having a combined sequencing and alignment feature.
Figure 5:
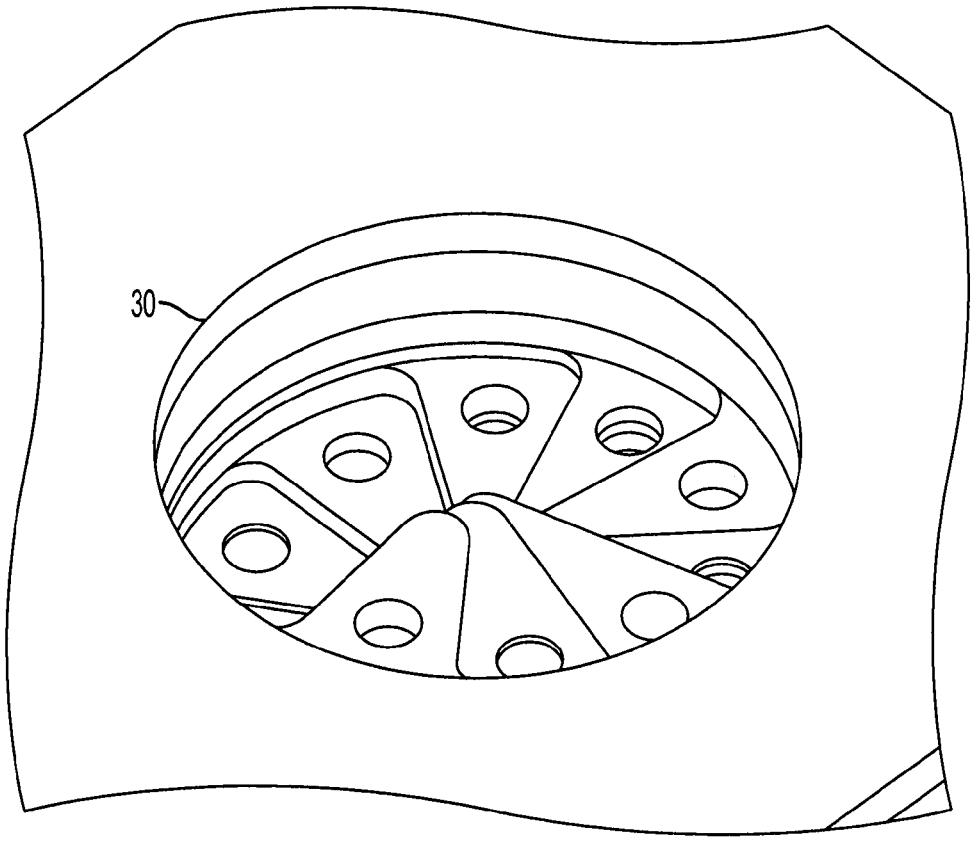
FIGS. 5-8 show an embodiment of a sequence of plates being stacked using a combined sequencing and alignment feature.

Using separate alignment and sequencing features takes up a lot of real estate on the plates. This runs counter to the desire for smaller printers with higher jet densities manufactured with smaller plates to reduce costs. FIG. 4 shows an embodiment of a jet stack having a combined alignment and sequencing feature 30. In this alignment feature, the stair stepped tabs have been replaced by pie-shaped tabs within a circular area. When sequenced correctly, the pie-shaped tabs form a spiral staircase type of approach as shown in perspective view in FIG. 5.

Figure 8:
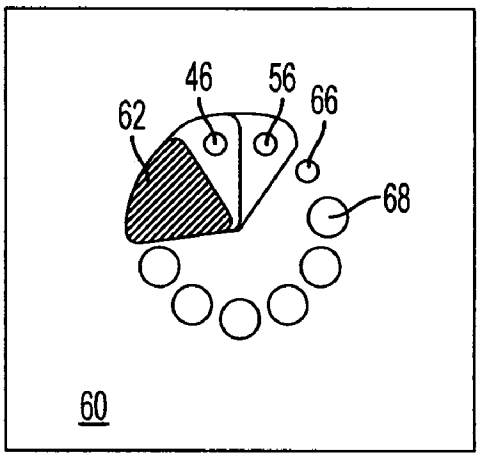
Figure 7:
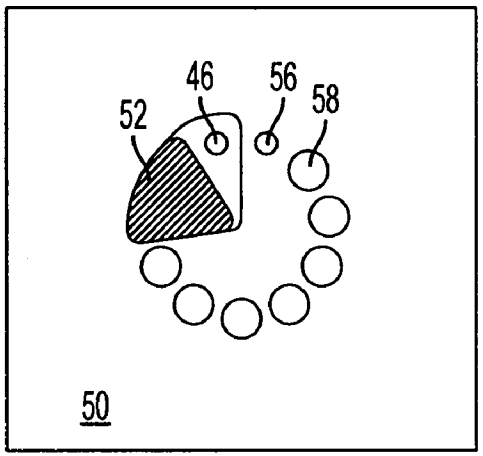
Figure 6:
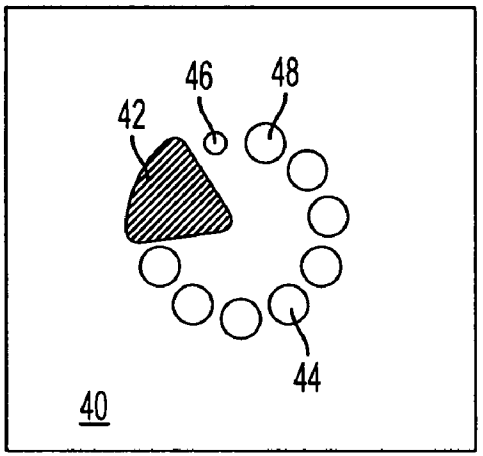

FIGS. 6-8 show a top view of a sequence of stacking one to three plates having a combined alignment and sequencing features. In this particular embodiment, each plate has a circle of holes with a cutout portion at a different location within the circle. In more general terms, the circle forms an array of alignment features, the alignment features in this embodiment consisting of holes. No limitations to these particular geometries are intended, nor should they be implied. The array could take any form, including an x-y grid, a square, a triangle, etc. Similarly, this example shows a cutout that is pie-shaped, but the cutout could have any shape, including round, triangular, rectangular, square, star-shaped, or be of any type of polygon.

FIG. 6 shows a first plate in the sequence. Using the orientation of bottom to top, the plate 40 in FIG. 6 would lie on the bottom of the stack. Plate 40 has an alignment feature 44. The alignment feature 44 is an array of plate alignment features 44, in this example a circle of holes. Each individual hole is referred to here as a 'plate' alignment feature to differentiate it from the over all 'stack' alignment feature consisting of the array of plate alignment features and the cutout.

The cutout 42 for this plate has an initial size selected to allow it to become increasingly large with each plate. Again, as mentioned previously, the particular embodiment shown here has a pie-shaped cutout, but other cutout shapes are possible.

Similarly, the array of alignment features shown here take the form of a circle, but other array shapes are of course possible, as well as the individual plate alignment features taking other forms than circular holes. Most of the plate alignment features are the same size as the other plate alignment features, but each plate has one differently-sized plate alignment feature. In the embodiment of FIG. 6, plate 40 has most of the plate alignment features sized similarly to hole 48. However, one plate alignment feature such as 46 would be of a different size. In this embodiment, hole 46 is smaller than the other holes, but depending upon how the plates are to be stacked, it would be possible to use a hole that is larger than the rest.

FIG. 7 shows the resulting view when a second plate, 50, lies on top of plate 40. The cutout 52 is larger in this embodiment, exposing the underlying portion of plate 40 and the differently sized plate alignment hole 46. In addition, the plate alignment hole 56 lies next to the cutout 52. The remaining holes in the stack alignment feature such as 58 are of the same size.

FIG. 8 shows the resulting view when a third plate, 60, lies on top of plate 50. The cutout 62 is even larger than the cutout 52, exposing the plate alignment hole 46 from plate 40 and the plate alignment hole 56 from plate 50. The plate alignment hole for plate 60, hole 66, lies adjacent the cutout. The remaining holes of the stack alignment feature such as 68 are all of a same size, with plate alignment hole 66 being differently sized.

Figure 9:
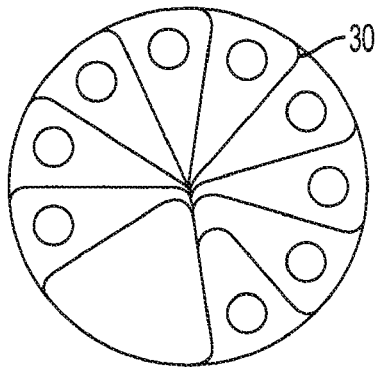
FIG. 9 shows a top view of an embodiment of a jet stack having properly sequenced plates.
Figure 10:
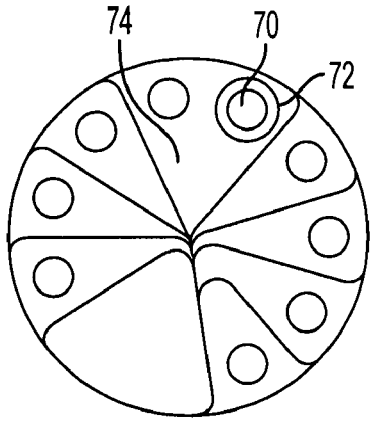
FIGS. 10-11 shows a top view of an embodiment of a jet stack having improperly sequenced plates.

FIG. 9 shows a top view of a properly sequenced and aligned jet stack. The proper sequencing verifies because all of the holes, or plate alignment features, within the stack alignment feature 30 appear to be the same size and in the same arrangement. Looking at FIG. 10, one can see where a sequencing error has occurred. Plate alignment feature or hole 70 appears 'inside' the regularly sized hole 72. Returning to FIGS. 6-8, this would occur if the plates 50 and 60 were out of order. The plate alignment hole 66 would appear inside hole 58 from plate 50. Further, the stair stepped tabs would lie in the wrong order as well, resulting in a double-wide tab at 74. This immediately notifies the assembler or vision system that the plates are out of order.

Figure 11:
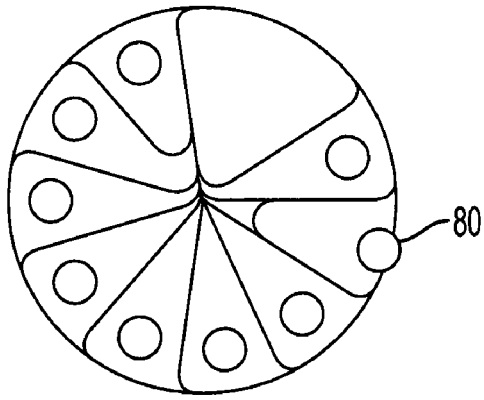

Similar to the ease of detecting plates having the incorrect sequence, plates that are misaligned will become very obvious. As can shown in FIG. 11, the tab 80 and is plate alignment hole are misaligned. This provides an immediate indicator that the plate upon which that tab resides is misaligned.

The embodiments shown here combine the plate sequencing and alignment features into one feature. This saves space on the plates of the jet stack, allowing for smaller plates. Smaller plates in turn lead to less material, easier handling and therefore lower costs. While the above discussion focused on a particular embodiment of a jet stacking feature, other variations exist.

Figure 12:
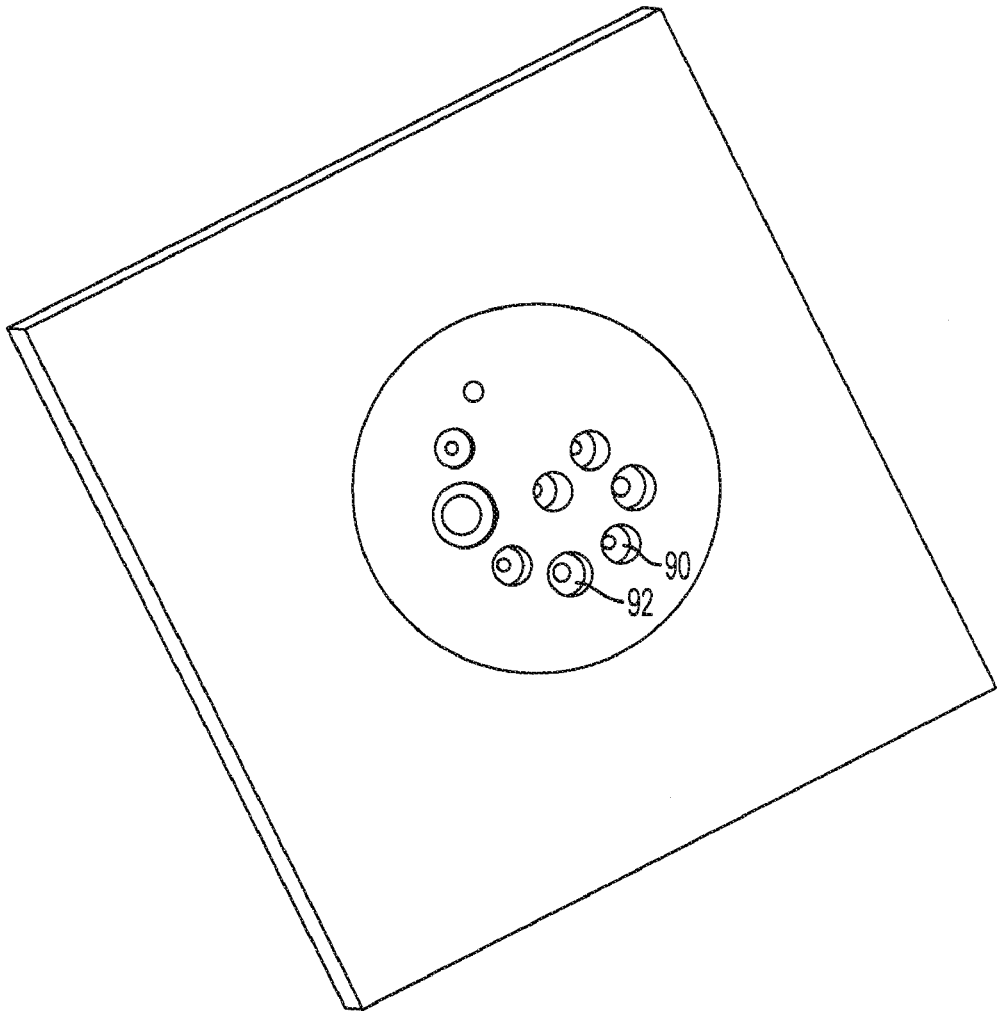
FIGS. 12-13 shows a top view of an alternative embodiment of a jet stack sequencing and alignment feature.
Figure 13:
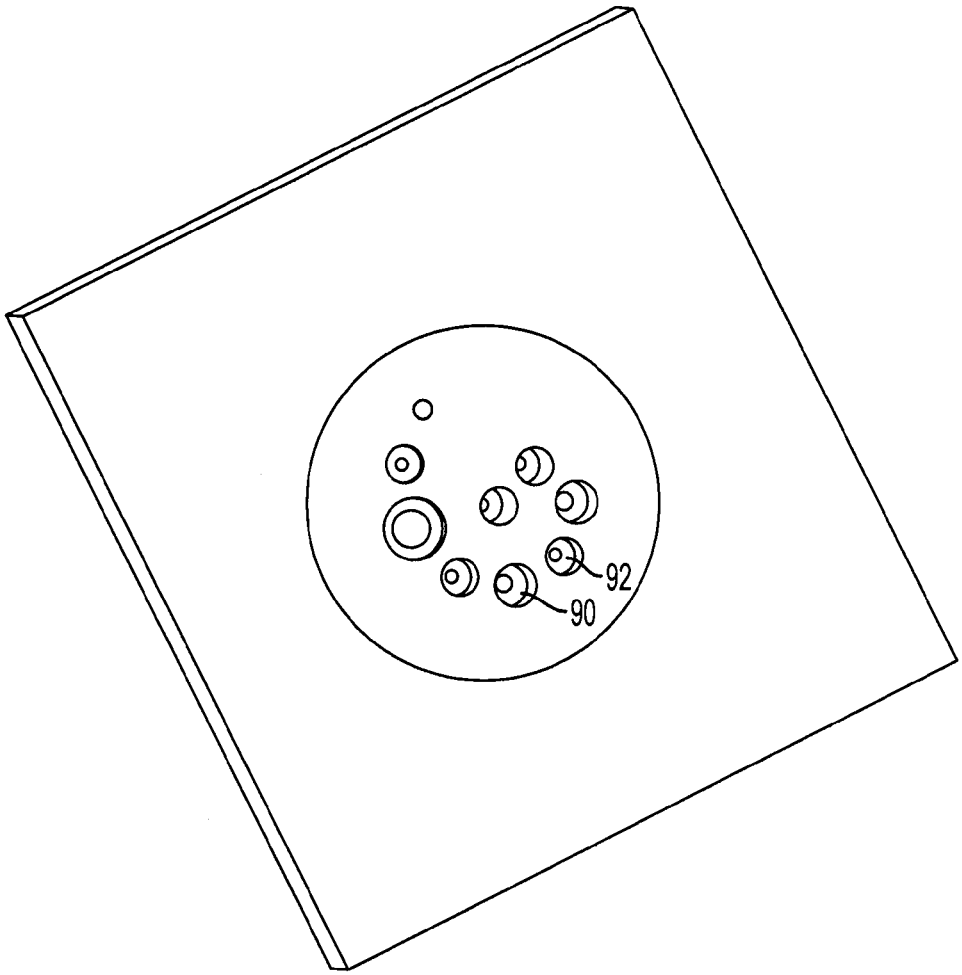

FIGS. 12 and 13 show an alternative embodiment of a combined stacking and sequencing feature. The plate alignment holes for each plate are formed in a spiral. The plate alignment holes are of different sizes and reside in different locations in a spiral. FIG. 12 shows two holes 90 and 92 that are in proper sequence. In FIG. 12, the plates corresponding to these holes are out of order. By human inspection, the mis-sequencing may be detectable with very careful attention to the depth of the holes. However, a vision system expecting a hole at a particular depth to the top plate may detect the mis-sequencing because the hole 92 has a depth that does not match the expected depth in FIG. 13. This shows an alternative arrangement to allow detection of mis-sequencing. The spiral arrangement of the holes will also allow detection of misalignment, as the hole in the spiral that should show the circle for the properly aligned plates would be out of alignment.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An apparatus, comprising:

a first plate having a first arrangement of alignment features with a first plate alignment feature in the first arrangement;

a first cutout in the first plate, the first cutout arranged adjacent the first plate alignment feature;

a second plate having a second arrangement of alignment features with a second plate alignment feature in the second arrangement, the second plate alignment feature being in a different position in the second arrangement than the position of the first plate alignment feature in the first arrangement; and a second cutout in the second plate, the second cutout arranged adjacent the second plate alignment feature, and the second cutout being larger than the first cutout.

2. The apparatus of claim 1, the apparatus comprising more than two plates, each plate having an arrangement of alignment features, each plate having a plate alignment feature in a different position than the other plate alignment features, and the cutouts for each plate being arranged such that the plate alignment features for each plate are viewable through a first surface of the apparatus.

3. The apparatus of claim 1, wherein the first and second arrangements of alignment features comprise one of a circle, a square, a rectangle, a triangle, a hexagon, an octagon, or an x-y array of alignment features.

4. The apparatus of claim 1, wherein the alignment features have a shape comprising one of circles, triangles, squares, rectangles, stars and polygons.

5. The apparatus of claim 1, wherein the alignment features comprise one of holes or surface markings.

6. The apparatus of claim 1, wherein the cutouts have a shape comprising of one of a pie, a rectangle, a triangle, a square, and a polygon.

7. The apparatus of claim 1, wherein the cutouts have a size selected so as to not weaken the plates.

8. A printhead jet stack, comprising:

a set of plates, each plate having a combined alignment and sequencing feature wherein the set of plates, when stacked, indicate proper alignment and sequencing by the combined feature.

9. The printhead jet stack of claim 8, wherein the combined alignment and sequencing feature comprises a series of cutouts, each one in a plate, with each cutout in subsequent plates being larger than the cutout of the previous plate, the cutouts arranged to expose a plate alignment feature on a previous plate.

10. The printhead jet stack of claim 9, wherein the cutouts have a shape comprising of one of a pie, a rectangle, a triangle, a square, and a polygon.

11. The printhead jet stack of claim 9, wherein the plate alignment features comprise one of holes or surface markings.

12. The printhead jet stack of claim 9, wherein the plate alignment features have a shape comprising one of circles, triangles, squares, rectangles, stars and polygons.

13. A print head jet stack, comprising:

a set of plates, each plate having an arrangement of alignment features, each arrangement having a plate alignment feature in a unique location within the arrangement and each plate having a cutout arranged adjacent the plate alignment feature, with each subsequent plate having a larger cutout than a previous plate;

the set of plates being aligned such that the alignment feature for each plate is viewable through an outer surface of the jet stack through the cutouts of the other plates; and the set of plates being bonded together to form the jet stack.

14. The printhead jet stack of claim 13, wherein the arrangement of alignment features comprises a set of holes arranged in a circle.

15. The printhead jet stack of claim 13, wherein the cutouts comprise pie-shaped cutouts, each plate having a pie-shaped cutout larger than a previous plate and smaller than a subsequent plate.

16. The printhead jet stack of claim 14, wherein the set of plates further comprise stainless steel plates.

17. The printhead jet stack of claim 14, wherein the printhead jet stack resides in a printhead of a solid ink jet printer.

* * * * *